United States Patent [19]

Robling

[11] 4,186,883

[45] Feb. 5, 1980

[54] ELECTROMAGNETIC FUEL INJECTION VALVE WITH SWIRL MEANS

[75] Inventor: Marc E. Robling, Warren, Mich.

[73] Assignee: Essex Group, Inc., Fort Wayne, Ind.

[21] Appl. No.: 904,077

[22] Filed: May 8, 1978

[51] Int. Cl.[2] ..... B05B 1/34

[52] U.S. Cl. ..... 239/491

[58] Field of Search ..... 239/491, 585, 533.9, 239/533.12, 492, 493, 463, 464, 471, 472, 473; 123/32 AE

[56] References Cited

U.S. PATENT DOCUMENTS 3,865,312 2/1975 Lombard et al. ..... 239/585

4,120,456 10/1978 Kimura et al. ..... 239/533.12

*Primary Examiner*—James B. Marbert .

*Attorney, Agent, or Firm*—Lawrence E. Freiburger; Robert D. Sommer

[57] ABSTRACT

An electromagnetic fuel injection valve having an electromagnetic actuator for moving a ball valve cooperating with a fixed valve seat. A metering orifice is located downstream from said valve seat and means for imparting a radial velocity component to fuel issuing from the injection valve is located in between the valve seat and the orifice. In addition, means is provided for minimizing the volume between the swirl means and the orifice without unduly restricting flow.

1 Claim, 4 Drawing Figures

10
12
14
16
18
20
22
24
26
32
32b
34
34a
36
38
40
42
44
46
48
50
52
54
56
58
58b
60
62
64
66
68
70
72
74
76
78
82
84
86
88
2
4

ELECTROMAGNETIC FUEL INJECTION VALVE WITH SWIRL MEANS

BACKGROUND OF THE INVENTION

This invention relates to fuel injection valves for internal combustion engines, and more particularly to pulse operated type fuel injection valves.

In order to minimize the amount of exhaust emissions in internal combustion engines, it is widely recognized that fuel and air should be mixed as evenly as possible. Further, it is widely recognized that in order to bring about this desired even mixing, that it is necessary that the fuel be atomized as finely as possible.

In the past it has been recognized that the desired atomization can be achieved by causing the fuel to be injected from the valve in a conical pattern. This conical pattern injection can be brought about by using a pintle valve arrangement. A typical patent showing a valve arrangement of this type is U.S. Pat. No. 3,450,353.

Another method utilized to cause a conical injection pattern is to employ some means for imparting a radial velocity component to the fuel as it flows from the injection valve. Typical devices employing this method are shown in U.S. Pat. Nos. 3,241,768; 3,528,613; 3,567,135 and 4,033,513.

In the prior art, it has been known to employ flat-faced armature-pole piece arrangements in electromagnetic fuel injection valves. As used herein, the term "flat-faced armature" is used to denote an armature-pole piece arrangement in which substantially all of the force of magnetic attraction between the two is parallel to the axis of the valve.

In addition, electromagnetic fuel injection valves employing ball type valves have been known in the prior art.

In general, all of the prior art electromagnetic fuel injection valves require tight tolerances on many of their components, most notably the output orifice, the valve seat, the valve element, and in many cases the fuel breakup or swirl device. Because of the necessity for such tight tolerances, the overall cost of the valve is excessive. Consequently, if the need for tight tolerances can be eliminated, it is clear that the overall cost of the fuel injection valve can be greatly reduced.

SUMMARY OF THE INVENTION

The present invention combines many prior art features previously known in a novel manner so as to eliminate the necessity for tight tolerances except in one component of the valve. More particularly, the electromagnetic fuel injection valve of the invention utilizes a ball type valve which is not as exacting in tolerance requirements as pintle type valves. Further, the present invention utilizes a swirl mechanism downstream from the ball valve mechanism which additionally does not require tight tolerances. An output orifice located downstream from the swirl mechanism is used as a metering orifice and is the one component of the fuel injection valve of the invention which requires a reasonably tight tolerance. Actuation of the valve of the invention is caused by a flat-faced armature-pole piece arrangement which utilizes the force of magnetic attraction between the two to its maximum potential. Further, the spring biasing force on the armature as well as valve seat position are adjustable to allow the valve to be adjusted to its optimum operating position.

BRIEF DESCRIPTION OF THE DRAWING FIGURES

DETAILED DESCRIPTION OF THE INVENTION

Figures 1, 2, 3:
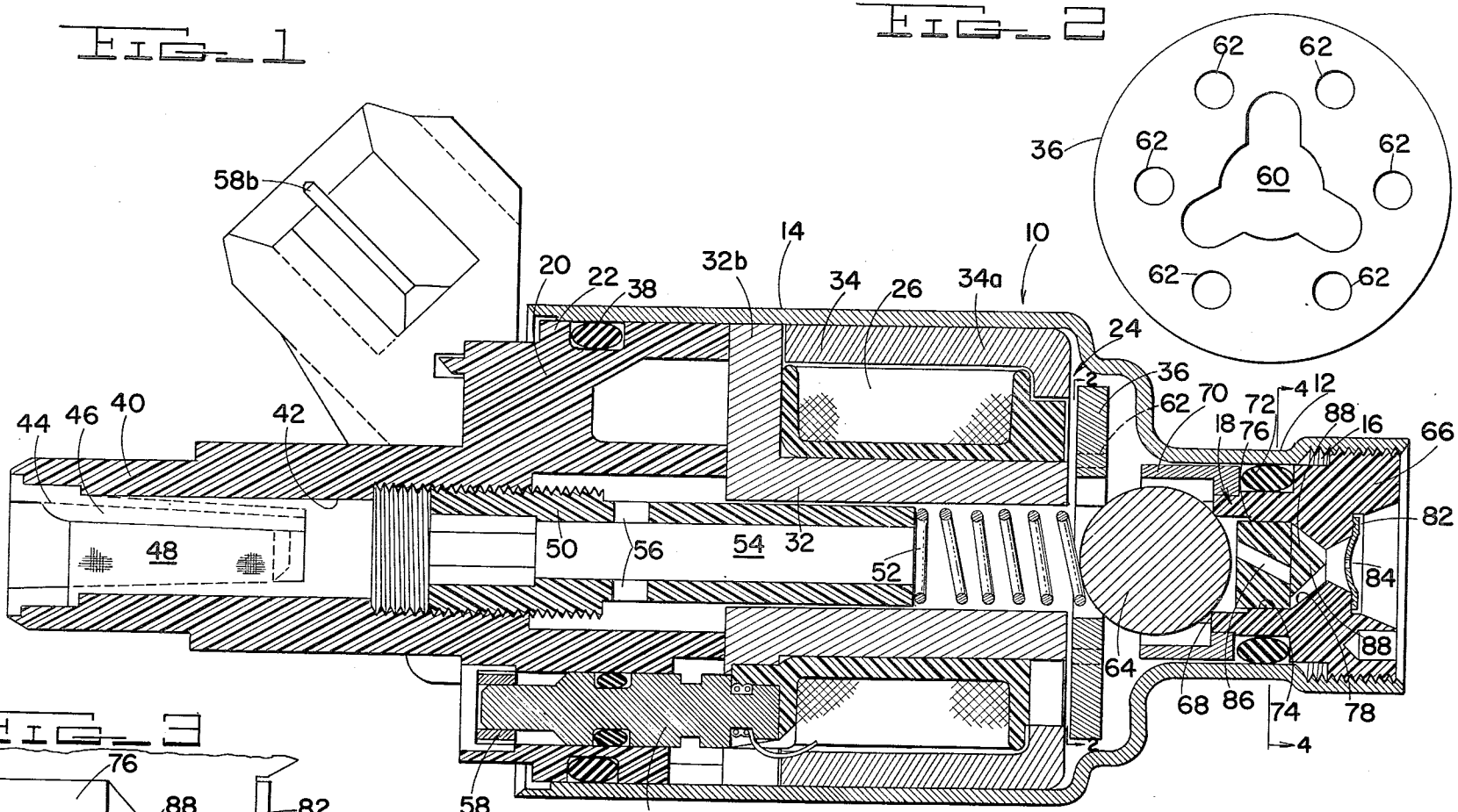
FIG. 1 is a cross-sectional view of a fuel injection valve in accordance with the present invention.
FIG. 2 is a cross-sectional view taken along line 2—2 of FIG. 1.
FIG. 3 is an enlarged elevational view of the swirl member and outlet orifice.
Figure 4:
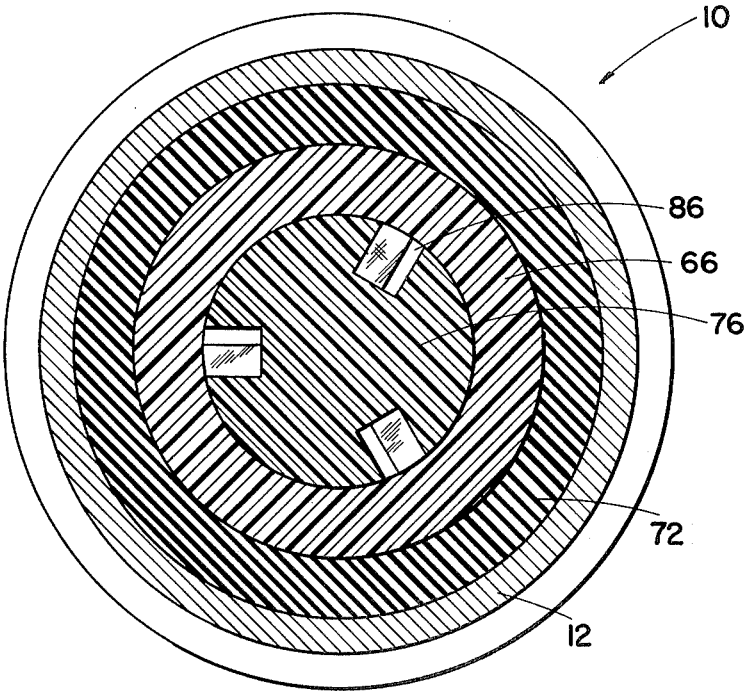
FIG. 4 is a cross-sectional view taken along lines 4—4 of FIG. 1.

Referring now to the drawing FIGURES an electromagnetic fuel injection valve in accordance with the present invention is preferably enclosed in a nonmagnetic tubular housing 10 having a forward nozzle section 12 of reduced diameter and a body portion 14. The nozzle section is internally threaded at 16 to allow axial adjustment of a valve seat assembly 18. The end of the body portion 14 is adapted to be peened over a radial flange 20 on an inlet tube 22 to hold the assembly together.

Contained within the body portion 14 is an electromagnetic actuator assembly 24 which creates axial movement to cause valve actuation. The electromagnetic actuator assembly includes an electromagnetic coil 26 wound upon a spool shaped bobbin 28 having an axial bore 30 therein. Further included in the electromagnetic actuator assembly is an electromagnetic frame assembly including an inner frame 32 and an outer frame 34. Inner frame 32 has an axially extending portion **32*a* located within the bore of bobbin 28 and a rear radial flange 32*b* which abuts against the rear of bobbin 28. Outer frame 34 is cup-shaped and includes an axially extending portion 34*a* situated between the outside of coil 26 and the inside surface of housing portion 14. The front end of outer frame 34 is bent radially inwardly to form a confronting surface with an axially movable washer-shaped armature 36. Both components of the frame assembly and armature 36** are constructed of magnetic material, as will be clear to those skilled in the art. Further, in order to avoid problems of the armature sticking due to residual magnetism, the armature is preferably coated with a nonmagnetic material such as chrome so as to provide a small air gap between it and the frame assembly when actuated.

Electromagnetic actuator assembly 24 is axially held in the housing by inlet tube 22 which carries an O-ring gasket 38 in its peripheral surface to seal against the inner surface of housing portion 14. Inlet tube 22 includes a connecting extension 40 which is to be connected to a fuel inlet tube (not shown). Inlet tube 22 has a central axial bore 42 in which a filter 44 consisting of a frame 46 and filter mesh 48 is situated near the inlet end. The outlet end of bore 42 is internally threaded to receive a tubular, threaded spring adjusting tube 50 which is thus axially movable. It will be noted that fuel not only flows through the axial bore 54 of spring adjusting tube 50, but also through radial outlets 56 which supply a flow of fuel to cool electromagnetic actuator 24. Electrical connections to electromagnetic coil 26 are made by wrapping each coil lead around a suitable electrically conductive pin terminal 59 (only one of which is shown) each of which is held in place on the coil bobbin. A resilient, unitary spring terminal 58 includes a female socket portion 58*a* which is inserted onto the male pin terminal, an intermediate portion (not shown) extending circumferentially around the axis of the valve, and a male blade portion 58*b* situated within a connector housing 60 mounted on inlet tube 22.

Referring now to FIG. 2, it will be seen that armature 36 is a washer-shaped member having a central aperture 60 and a plurality of spaced apertures 62. Ball valve element 64 is attached to central aperture by welding or other suitable methods and is preferably made of steel, although other materials are suitable. It will be noted that bias spring 52 extends through aperture 60 and bears directly on ball valve element 64 rather than armature 36. Thus, if ball valve element 64 and armature 36 should ever become detached from one another, the valve will remain in the closed position. Additionally, it will be noted that the apertures in armature 36 reduce the armature's resistance to move through fuel located inside valve cavity as it is opened and closed, thus decreasing opening and closing time intervals.

Valve seat assembly 18 includes a threaded valve seat member 66 which cooperates with internal threads on the housing portion 12 to allow axial adjustment of annular valve seat 68. Valve seat member 66 further includes a rearwardly extending tubular guide 70 which serves to guide ball valve 64 to prevent radial misalignment of the valve and valve seat 68. A peripheral slot in valve member 66 carries an O-ring gasket 72 which provides a seal to prevent fuel from escaping. Valve seat 68 leads into a reduced diameter bore 74 occupied by a swirl member 76 which then is reduced in diameter by a truncated conical reducing section 78 followed by a truncated conical diameter increasing section 80. At the outlet of conical section 80, a plate 82 having a metering orifice 84 therein is situated so that the orifice is aligned with the axis of the valve. An additional chamber in the form of a truncated cone is located at the outlet of orifice 84 with the diameter of the cone increasing away from the orifice.

Swirl disc 76 is specifically adapted to impart a radial velocity component to the fuel flowing through the valve so that the distribution of atomized fuel exiting from the valve is in a conical shape. This radial velocity component is imparted to the fuel as it flows through channels 86 in the surface of disc 76 which are inclined at an angle with respect to the valve axis. The optimum angle and total volume of the channels 86 vary, of course, on many parameters such as velocity of the fuel, the size of the conical shape desired, output orifice size and others. It is well within the skill of those skilled in the art to determine the optimum angle and volume for channels 86 by using conventional techniques. By way of example, and not by way of limitation, it has been determined that for one particular valve design the optimum angle is 25°. The volume of swirl channels 86 is chosen so that they do not unduly restrict flow but at the same time, they cannot be made unduly large because the volume between the valve seat 68 and orifice 84 should be held to a minimum. This is necessary because fuel does not flow from orifice 84 in an even spray pattern until the volume between the valve seat and orifice is completely filled up. As fuel exits from swirl channels 86, the radial velocity component causes the desired atomization. Because the volume between the valve seat and orifice 84 is to be held to a minimum, it is necessary to make the output end 88 of swirl disc 76 conical. However, the degree of taper of output end 88 and truncated portion 78 are different in order to maintain a constant cross-sectional flow area.

The swirl disc may be formed from conventional plastics able to withstand the valve's environment by conventional molding techniques. Preferably valve seat member 66 is constructed of a material such as STEEL which is hard enough to perform properly for a reasonable lifetime as a valve seat.

Operation of the electromagnetic fuel injection valve thus far described will be clear to those skilled in the art, but for sake of a complete understanding, operation of the device will be briefly described. First in assembling the device, it will be noted that the biasing force on ball valve 64 is adjusted prior to inserting filter 48 into the bore of inlet tube 22 by inserting a suitable tool into the bore and adjusting member 50 to provide optimal biasing on ball valve 64. Secondly, valve seat 68 can also be axially adjusted by threading valve seat member 18 to the desired position.

It will be appreciated by those skilled in the art that the above two described adjustments eliminate the necessity for tight tolerances on many of the components. Further, all the components of the valve of the invention have been designed for easy producibility and assembly with the exception of metering orifice 84 which requires a rather tight tolerance in order to provide the proper metering function. In addition, many of the valve components have been designed for maximum performance. For example, in many prior art valve designs, the housing is a portion of the magnetic circuit. Thus, in many prior art valves, the housing was necessarily a compromise between the housing design and the magnetic circuit. In the present invention, however, the magnetic circuit is separate from the housing and is designed for maximum performance. For example, the frame assembly and flat-faced armature construction makes maximum use of the electromagnetic coil.

A preferred form of the invention has been disclosed. Modifications will occur to those skilled in the art and it is intended that the claims cover the invention as broadly as prrior art will permit.

What is claimed is:

1. An electromagnetic fuel injection valve, comprising:

a tubular housing including inlet means and outlet means axially aligned at opposite ends of said housing;

an electromagnetic actuator situated axially within said housing including a spool-shaped bobbin, an electromagnetic coil wound upon said bobbin, and a frame assembly comprising inner and outer frame pieces arranged to form a pole piece at the outlet end of said actuator;

a washer-shaped electromagnetic armature situated axially between said pole piece and said outlet and arranged to be axially attracted to said pole piece, said pole piece and said armature being of such configuration so that there is substantially no magnetic force of attraction between them other than at right angles to the face of said armature;

a valve seat downstream from said electromagnetic armature;

a spherically-shaped valve member attached to said armature and arranged to cooperate with said valve seat to control flow of fuel therethrough;

spring biasing means acting to urge said spherical valve member toward the closed position;

an orifice downstream of said valve seat; and swirl means located between said valve seat and said orifice for imparting a radial velocity component to fuel flowing through said valve seat, said swirl means comprising a plug member occupying the cavity between said valve seat and said orifice, said plug member separting the cavity between said valve seat and said orifice into an entrance cavity at the outlet of the valve seat and an exit cavity adjacent to said outlet orifice, said exit cavity being defined by a conical extension of said plug member and a corresponding conically shaped wall on said housing, passageways in said plug member inclined at angle with respect to the valve axis for imparting a radial velocity to fuel flowing from the valve.

* * * * *